US006744411B1

(12) United States Patent
Osterhues et al.

(10) Patent No.: US 6,744,411 B1
(45) Date of Patent: Jun. 1, 2004

(54) ELECTRONICALLY SCANNED ANTENNA SYSTEM, AN ELECTRICALLY SCANNED ANTENNA AND AN ASSOCIATED METHOD OF FORMING THE SAME

(75) Inventors: Gordon D. Osterhues, Irvine, CA (US); Julio Angel Navarro, Kent, WA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 10/328,415

(22) Filed: Dec. 23, 2002

(51) Int. Cl.[7] ..... H01Q 19/06
(52) U.S. Cl. ..... 343/754; 343/797; 343/876
(58) Field of Search ..... 343/754, 755, 343/756, 797, 795, 853, 876, 781 CA, 781 P, 781 R; 342/373, 374, 375

(56) References Cited

U.S. PATENT DOCUMENTS

| | | | | |
|---|---|---|---|---|
| 4,905,014 A | | 2/1990 | Gonzalez et al. | |
| 5,001,495 A | * | 3/1991 | Chekroun | 343/754 |
| 5,864,322 A | | 1/1999 | Pollon et al. | |
| 6,031,506 A | | 2/2000 | Cooley et al. | |
| 6,072,438 A | | 6/2000 | McKay et al. | |
| 6,081,234 A | * | 6/2000 | Huang et al. | 343/700 MS |
| 6,081,235 A | | 6/2000 | Romanofsky et al. | |
| 6,091,371 A | * | 7/2000 | Buer et al. | 343/754 |
| 6,326,931 B1 | | 12/2001 | Falk | |
| 6,351,247 B1 | * | 2/2002 | Linstrom et al. | 343/797 |
| 6,396,449 B1 | * | 5/2002 | Osterhues et al. | 343/754 |
| 6,424,313 B1 | | 7/2002 | Navarro et al. | |
| 6,426,727 B2 | | 7/2002 | Gilbert | |
| 2001/0035801 A1 | | 11/2001 | Gilbert | |
| 2001/0050650 A1 | | 12/2001 | Gilbert | |
| 2002/0003497 A1 | | 1/2002 | Gilbert et al. | |

* cited by examiner

*Primary Examiner*—Tan Ho
(74) *Attorney, Agent, or Firm*—Alston & Bird LLP

(57) ABSTRACT

An electronically scanned antenna system includes a plurality of array elements and a control system. Each array element has a plurality of reflecting components capable of reflecting an electromagnetic wave incident thereon. Each reflecting component, in turn, is interconnected to at least one reflecting segment by at least one switch. In this regard, when the switches are in a closed state the respective reflecting segments are electrically coupled to the respective reflecting components to thereby alter a reflective geometry of the respective reflecting components. The control system is capable of controlling the switches to thereby control the array elements to provide a desired degree of phase shift to a signal reflected from the antenna. Advantageously, the control system is capable of controlling the switches of one reflecting component at the same time the control system controls corresponding switches of other reflecting components.

25 Claims, 5 Drawing Sheets

ELECTRONICALLY SCANNED ANTENNA SYSTEM, AN ELECTRICALLY SCANNED ANTENNA AND AN ASSOCIATED METHOD OF FORMING THE SAME

FIELD OF THE INVENTION

The present invention generally relates to antennas and, more particularly, relates to electronically scanned antennas with reconfigurable dipoles and an associated method of operation.

BACKGROUND OF THE INVENTION

Radar and communication systems require antennas to transmit and receive electromagnetic (EM) signals, generally in the microwave or millimeter wave spectrum. One class of antennas is the electronically scanned antenna (ESA). In an ESA, the signal is transmitted and received through individual radiating elements distributed uniformly across the face of the antenna. Phase shifters in series with each radiating element create a well-formed, narrow, pencil beam and tilt its phase front in the desired direction (i.e., "scan" the beam). A computer electronically controls the phase shifters. ESAs offer fast scan speeds and solid state reliability.

While ESAs have proven effective in many applications, the main deterrent to their widespread application is their high cost. Another drawback is that ESAs have higher insertion losses associated with their phase shifters than mechanically scanned antennas. These losses increase the output power required of the transmitter of the ESA which, in turn, increases its cost, power supply requirements and thermal management due to the increased power dissipation.

One approach to overcome the aforementioned loss issued is the use of an active ESA (AESA). The AESA is constructed by pairing amplifiers with phase shifters in the antenna. An AESA incorporates a power amplifier to provide the requisite transmitted power, a low noise amplifier to provide the requisite receiver sensitivity and a circular connecting the transmit and receive channels to the radiating element. This approach is viable for small arrays, i.e., arrays of a few hundred elements. But for a given antenna size, the number of radiating elements increases as the square of the frequency. Thus, for a high gain, millimeter wave antenna, the array often contains thousands of elements. In such an instance, cost, packaging, control, power distribution and thermal management issues become significantly important concerns.

Space-fed configurations using a passive ESA (PESA) promise to be less expensive than AESAs for millimeter wave applications. A PESA does not use distributed amplifiers, but instead relies on a single high power transmitter and a low loss antenna. The reason for the lower cost is the simpler, space-fed architecture of such an antenna that has fewer, less expensive parts. A PESA can be implemented in a number of quasi-optic configurations such as a focal point or offset J-feed reflection antenna, as a transmission lens antenna, as a reflection Cassegrain antenna, or as a polarization twist reflection Cassegrain antenna. But since PESAs do not have amplifiers to overcome the circuit losses, such losses, and particularly the phase shifter losses, become a key issue.

One approach to reduce phase shifter insertion loss is to implement the phase shifter with a micro-electromechanical system (MEMS) switch. The MEMS switch can be employed as the control device in various types of phase shifter designs. Since it has an electromechanical switch, it offers low insertion loss. A microwave monolithic integrated circuit (MMIC) of MEMS-based phase shifters and radiators can be fabricated as a sub-array. This scale of integration promises lower costs. But MEMS-based MMIC phase shifters remain expensive and their integration into a full array will be even more costly for a millimeter wave antenna. They are also relatively fragile compared to solid-state devices and require high control voltages, such as 70 Volts. For some configurations, packaging the phase shifter and radiator(s) in the requisite cell area, the maximum area that the radiating element can occupy for proper operation over a given maximum frequency and scan angle, is also difficult.

SUMMARY OF THE INVENTION

In view of the foregoing background, the present invention provides an improved electrically scanned array antenna and a method of forming the same. According to embodiments of the present invention, the antenna includes an array of array elements that can be controlled to thereby impart a desired degree of phase shift to an electromagnetic signal received thereon. Advantageously, this is accomplished without the need for any electromechanical phase shifters. Also, the array can be formed as a single layer including the array elements formed on a substrate. As such, the array can be less complex and can be less expensive to fabricate, when compared to more conventional multi-layer antenna designs. In addition, for an electronically scanned antenna fabricated according to embodiments of the present invention, the wafer costs will be less than a Gallium Arsenide (GaAs) wafer used in MEMS/MMIC phase shifters. It is also more amenable to large wafer sizes that can accommodate an entire array in a single wafer. In this regard, the construction of the antenna according to embodiments of the present invention is less complex and may exhibit less loss than MEMS/MMIC technology.

According to one aspect of the present invention, an electronically scanned antenna system includes a plurality of array elements and a control system. Each array element has a plurality of reflecting components, such as resonant cross dipoles, capable of reflecting an electromagnetic wave incident thereon. Each reflecting component, in turn, is interconnected to at least one reflecting segment, such as a dipole segment, by at least one switch, such as a transistor. In this regard, when the switches are in a closed state the respective reflecting segments are electrically coupled to the respective reflecting components to thereby alter a reflective geometry of the respective reflecting components. The control system is capable of controlling the switches to thereby control the array elements to provide a desired degree of phase shift to a signal reflected from the antenna. Advantageously, the control system is capable of controlling the switches of one reflecting component at the same time the control system controls corresponding switches of other reflecting components.

More particularly, where the reflecting components comprise resonant cross dipoles and the reflecting segments comprise dipole segments, each resonant cross dipole can comprise two crossing dipole arms, at least one of which is interconnected to a dipole segment of a first length. Also, at least one of the dipole arms is interconnected to a dipole segment of a second length that is shorter than the first length. In one such arrangement, each dipole arm can be interconnected to a dipole segment of the first length on one end and a dipole segment of the second length on an opposing end. The antenna can therefore provide a first degree of phase shifting to a received electromagnetic signal when the dipole segments of the second length are electrically coupled to respective dipole arms.

In addition to being interconnected to a dipole arm by a switch, at least one dipole segment of the second length can be interconnected to another dipole segment by another switch on an opposing end. In such an arrangement, the antenna can provide a first degree of phase shifting to a received electromagnetic signal when the dipole segments of the second length are electrically coupled to respective dipole arms. In addition, the antenna can provide a second degree of phase shifting to a received electromagnetic signal when the dipole segments of the second length are electrically coupled to respective dipole arms and the other dipole segments are electrically coupled to respective dipole segments of the second length. Further, the antenna can provide a third degree of phase shifting to a received electromagnetic signal when all of the dipole segments are electrically coupled to respective dipole arms, and all of the other dipole segments of the second length are electrically coupled to respective dipole segments of the second length.

An electrically scanned antenna and method of forming the same are also provided.

BRIEF DESCRIPTION OF THE DRAWINGS

Figure 1:
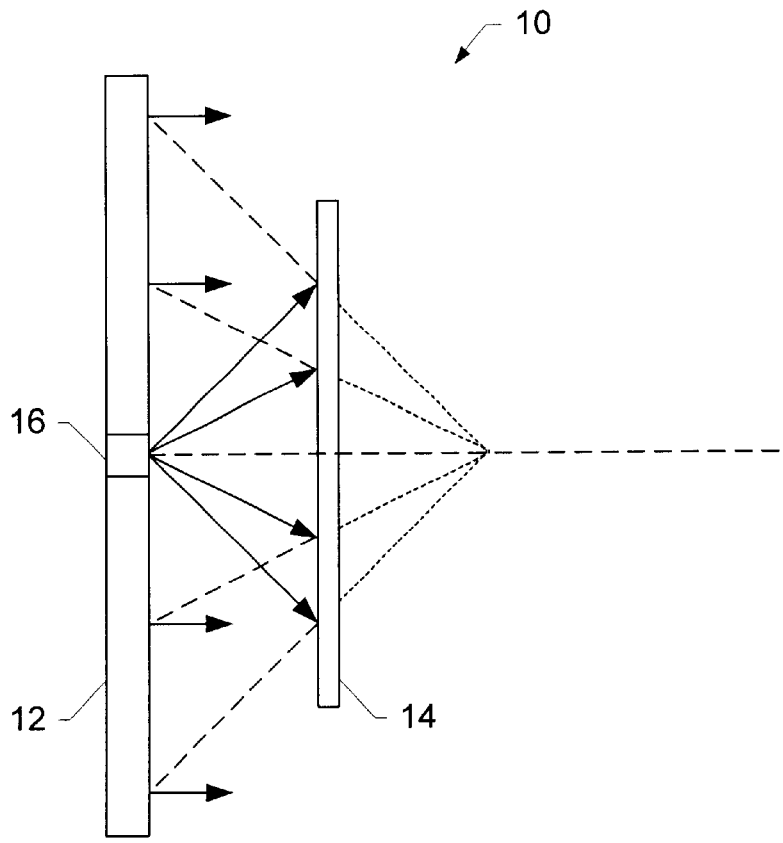
Figure 2:
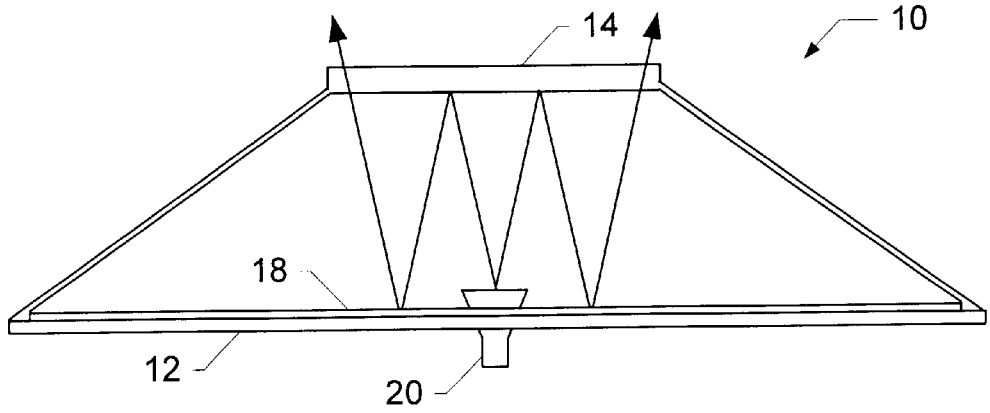
Figure 3:
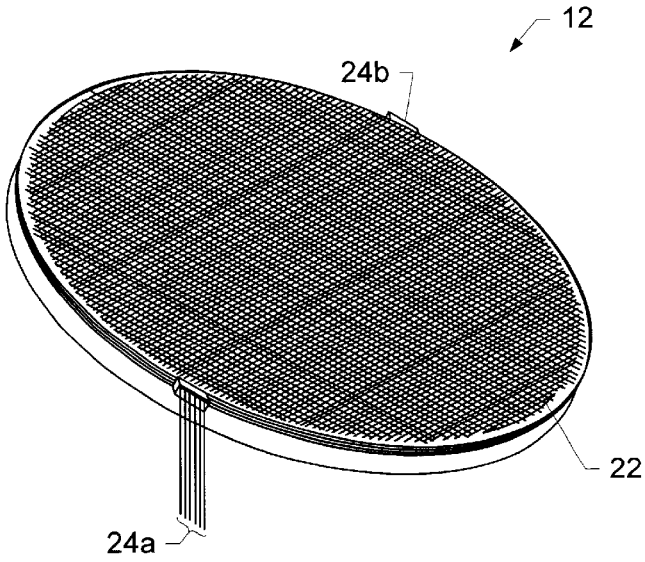
Figure 4:
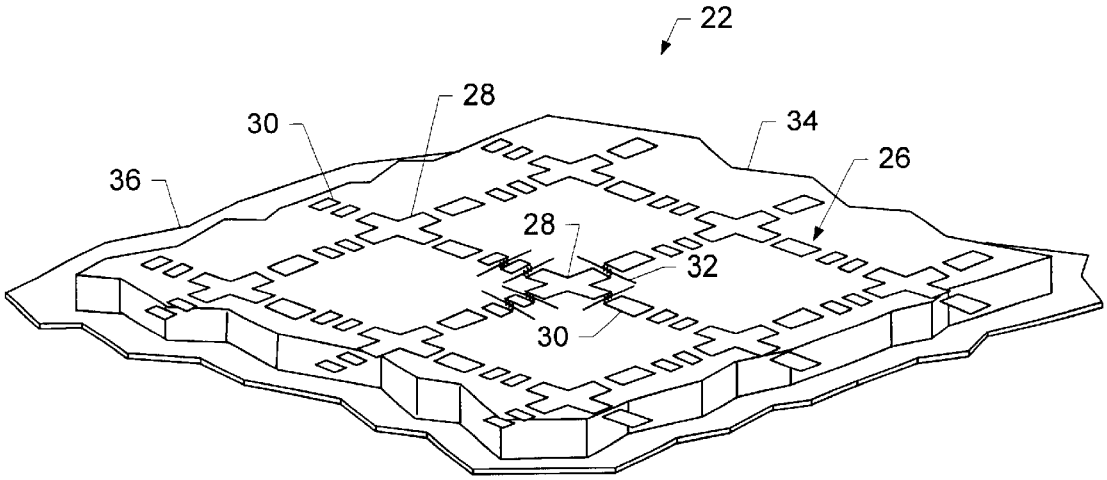
Figure 5:
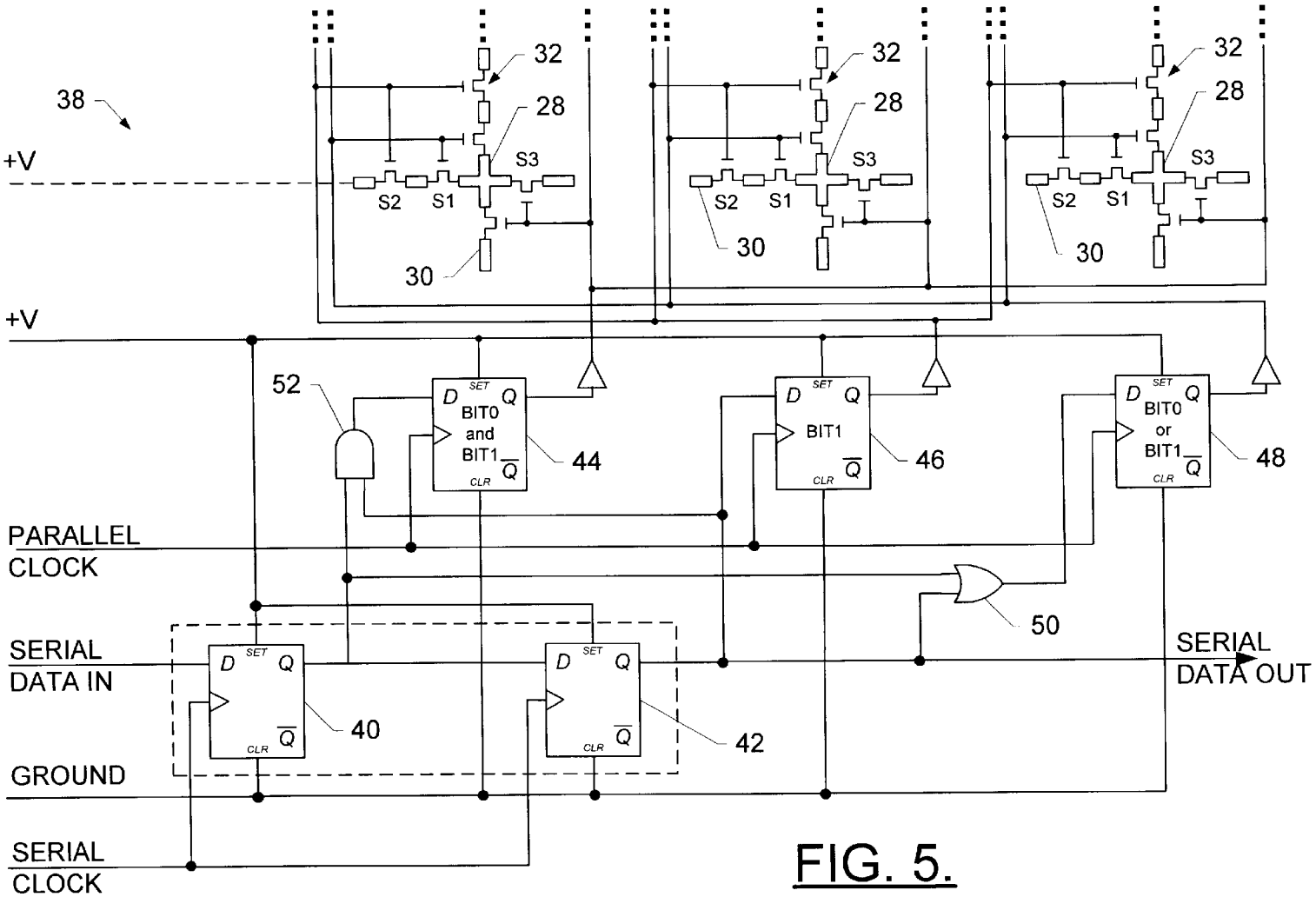
Figure 6A:
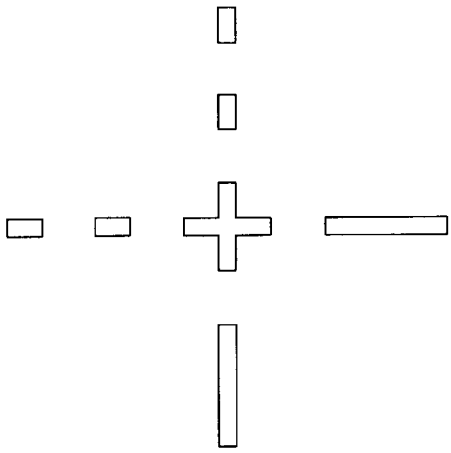
Figure 6B:
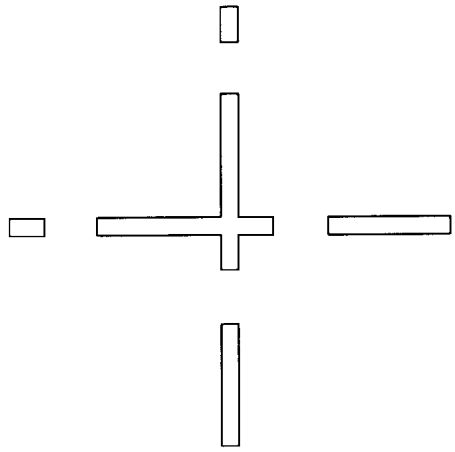
Figure 6C:
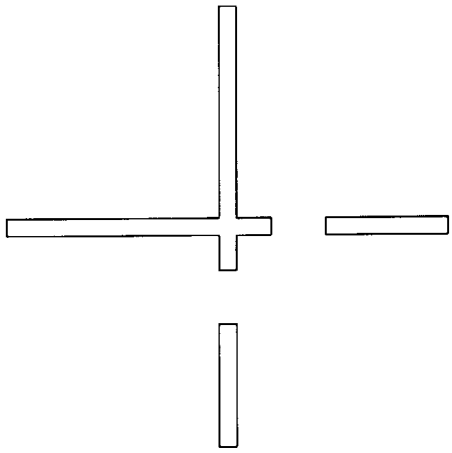
Figure 6D:
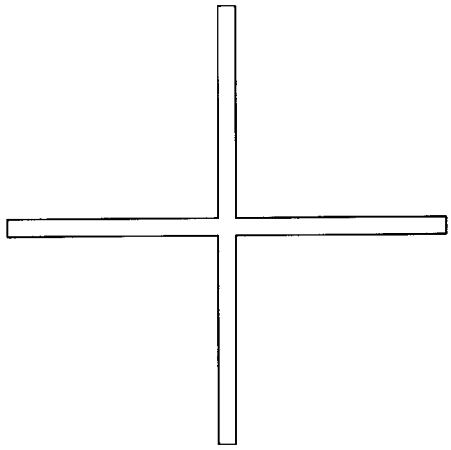
Figure 7:
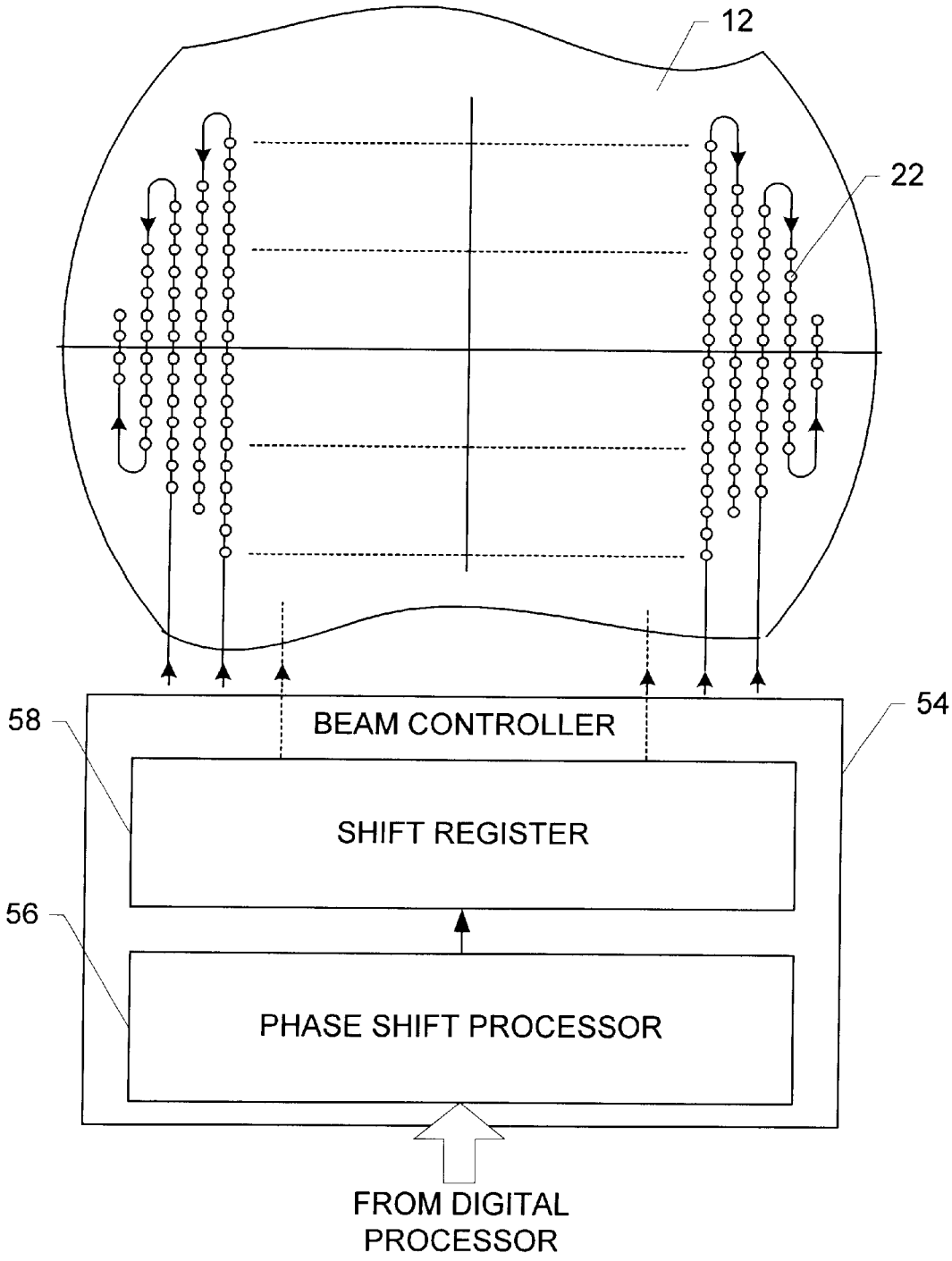

Having thus described the invention in general terms, reference will now be made to the accompanying drawings, which are not necessarily drawn to scale, and wherein:

FIG. 1 is a schematic side view of an electronically scanned antenna with reconfigurable dipoles in accordance with one embodiment of the present invention, wherein the antenna is illustrated in the configuration of a Cassegrain antenna;

FIG. 2 is a schematic side view of an electronically scanned antenna with reconfigurable dipoles in accordance with one embodiment of the present invention, wherein the antenna is illustrated in the configuration of a polarization twist Cassegrain antenna;

FIG. 3 is a perspective view of an electronically scanned antenna with reconfigurable dipoles in accordance with one embodiment of the present invention;

FIG. 4 is an enlarged schematic perspective view of one array element of an electrically scanned antenna with reconfigurable dipoles in accordance with one embodiment of the present invention;

FIG. 5 is a simplified schematic drawing of a control circuit for controlling the switches associated with the array element of one embodiment of the present invention;

FIGS. 6A–6D are schematic illustrations of the effective geometry of one reflective component of an array element for imparting different phase shifts on electromagnetic signals incident upon the antenna; and FIG. 7 is a block diagram of a beam controller for controlling the switches associated with the antenna in accordance with one embodiment of the present invention.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Referring to FIG. 1, there is shown an antenna 10 in accordance with a preferred embodiment of the present invention. The antenna is shown in the form of a Cassegrain antenna, but it will be appreciated immediately that the present invention is just as readily adaptable to various other quasi-optic antenna configurations such as a focal point or offset J-feed, a polarization twist Cassegrain (see FIG. 2), as a transmission lens, or in other configurations. Also, the surfaces of the main reflector and subreflector may have parabolic shapes, hyperbolic shapes or flat shapes.

The antenna 10 includes an array 12 spaced apart from a subreflector 14. A feed aperture 16 allows a polarized signal to be directed at the subreflector, which is then reflected by the subreflector back to the main reflector that includes the array. A desired phase shift is imparted to the signal by the array, and the signal is reflected back toward the subreflector and radiates into space. As shown in FIG. 2, a polarization twist Cassegrain mitigates the blockage of the subreflector. Such a configuration requires a polarization sensitive subreflector and the insertion of a circular polarizer 18 in front of the main reflector and below the output of a feed horn 20.

FIG. 3 illustrates the array 12 in greater detail. The array may vary significantly in dimensions but, in one preferred form, comprises a disc many wavelengths in diameter. The array is comprised of a large plurality of array elements 22 formed in cells positioned significantly close to one another so as to avoid grating lobes at the highest frequency and widest scan angle of operation. The array elements each include a single layer and a ground plane. The array elements are comprised of reflective components consisting of a plurality of cross dipoles (arranged in an N×N matrix), that are each interconnected to dipole segments by transistor switches, which will be described in greater detail in the following paragraphs.

The array elements 22 are electrically coupled to an electronic control circuit via a group of control lines 24*a* and 24*b*. The control lines preferably radially oppose one another and are used to couple the layer of the array elements to the control circuit to provide a means for transmitting electrical switching signals to the array elements to achieve a desired degree of phase shifting of the signal transmitted from the array.

Referring now to FIG. 4, one array element 22 is shown in a highly enlarged fashion. In advantageous embodiments, the array element comprises a single layer of reflective components, such as resonant cross dipoles, and reflective segments, such as dipole segments, disposed closely adjacent one another and formed on a substrate 34 (described below). In this regard, by having the array element comprise a single layer, the array 12 is less complex and can be less expensive to fabricate, when compared to more conventional multi-layer antenna designs. More particularly, the layer includes an anti-reflective coating covering a switched grid 26 of cross dipoles interconnected to dipole segments by switches. The switches 32 can comprise any of a number of different switches but, in the preferred embodiment, comprise MOSFET switches. The reflective components are illustrated as resonant cross dipoles (cruciforms) 28 comprising crossing dipole arms, however, it will be appreciated that resonant dipoles, or any other configuration that provides a reflective surface at the operating frequency, could be used.

To configure the geometry of the dipoles, the size of the dipole arms are selectively increased by coupling the cross dipoles 28 to dipole segments 30 by a plurality of switches 32, six of which are shown in FIG. 4. In this regard, the lengths of the dipole arms are typically selected to be between 0.1 and 0.9 at the operating frequency. The dipole segments can be configured in any one of a number of manners and have any number of different sizes. According to one embodiment, the dipole segments are coupled to the ends of the dipole arms, and have various sizes to thereby effectively increase the length of the dipole arms by various amounts. Also, dipole segments can be coupled to one another, with at least one dipole segment coupled on one end to a dipole arm, and to another dipole segment on an opposite end. In this regard, the length of the dipole arm can be increased to one of two sizes, depending on the state of the respective switches. The total length of the dipole arms and dipole segments coupled thereto directly or indirectly is typically between 0.1 and 0.9 at the operating frequency. And the width of the dipole arms and dipole segments are typically selected to be between 0.1 and 0.9.

Each array element 22 is comprised of a plurality of cross dipoles arranged in an N×N matrix, with at least one arm of one cross dipole coupled to at least one dipole segment by a switch. The reflective components are preferably formed on a substrate 34, such as a polymide or a glass substrate. Thus, the single layer of each array element includes a switched grid 26 of cross dipoles interconnected to dipole segments by switches 32, all of which are formed on the substrate. The substrate can have a thickness selected in any one of a number of different manners but, in one embodiment, the substrate has a thickness between $1/16\lambda$ and $1/8\lambda$ of the operating frequency. A ground plane 36, which may comprise a thin layer of metal, is formed on the side of the substrate opposite the array element. The control lines supply the address, data and supply voltages to switch the transistor switches open (reflective) or closed (transmissive) to thereby decrease or increase the length of the dipole arms, respectively, as illustrated in the control circuit block diagram of FIG. 5.

With reference to FIG. 5, a control circuit 38 for controlling an array element 22 is illustrated. The control circuit incorporates a plurality of D-type flip-flops. For example, in an embodiment where each array element comprises nine dipoles arranged in a 3×3 matrix, the control circuit can comprise five D-type flip flops 40–48. Flip-flop 44 has its output connected to at least one switch (designated S3) coupling at least one arm of each cross dipole to a dipole segment. Flip-flop 48 also has its output connected to at least one switch (designated S1) coupling at least one arm of each dipole to a dipole segment. As shown, the arm(s) of the dipole coupled to respective dipole segments by flip-flops 44 and 48 are preferably the same arm(s) of each dipole in the array element. In contrast to flip-flops 44 and 48, flip-flop 46 has its output connected to at least one switch (designated S2) coupling at least one dipole segment to at least one further dipole segment. As shown, the dipole segments connected on one end to switch(es) controlled by flip-flop 48 are coupled to a further dipole on an opposite end by switches controlled by flip-flop 46. In this regard, by selecting the state of the switches coupled to flip-flops 46 and 48, the lengths of the dipole segments can be effectively added, and added to the length of the respective arms of respective cross dipoles.

An OR-gate 50 receives outputs from flip-flop 40 and flip-flop 42, and provides an output to the "D" input of flip-flop 48. Also receiving outputs from flip-flop 40 and flip-flop 42, an AND-gate 52 provides an output to the "D" input of flip-flop 44. The logic states, either a "1" or a "0," of flip-flops 44–48 are updated as a function of the logic states of flip-flops 40 and 42 at the time an appropriate transition (from positive to negative or vice versa, depending on the detailed circuit design) on the "Parallel Clock" line occurs. The flip-flops 44–48 then configure the array element 22 as described above. At the time an appropriate transition on the "Parallel Clock" line occurs, the states of flip-flops 40 and 42 represent a 2-bit control word that represents a phase shift to be imparted by a respective array element based on its configuration. For example, in the illustrated embodiment, the 2-bit control word may assume values of 00, 01, 10 and 11, which represent a phase shift of 0, 90, 180 or 270 degrees, respectively. The 2-bit control word is stored in flip-flops 40 and 42 after a serial data transfer from the "Serial Data In" connection to the "D" input of flip-flop 40. A predetermined number of serial data transfers takes place before the 2-bit control word corresponding to this phase shifter is in place for all array elements of the array 12 (all other phase shifter control words will arrive at registers corresponding to their phase shifters at the same time).

Turning now to the operation of antenna 10, reference will be made again to FIG. 4. When all of the switches of each array element (S1, S2 and S3) are open (i.e., non-conducting), the geometry of the cross dipoles 28 comprises only the lengths of the arms of the dipoles themselves. Accordingly, an electromagnetic wave "w" incident on the array element is reflected by only the cross dipoles and sets the reference or zero phase shift value at the face of the array. This condition is illustrated in FIG. 6A. If switches SI are closed (i.e., conducting), the arms of the cross dipoles become electrically coupled to the respective dipole segments. The size of the respective cross dipole arms, in turn, effectively increases by the length of the respective dipole segments. Accordingly, electromagnetic signals incident on the array element reflect off the array element with a phase shift of 90 degrees. This condition is illustrated in FIG. 6B.

By closing switches S2, the dipole segments connected on either end of switches S2 become electrically coupled. And as shown, closing switches S2 also closes switches S1 because the same state of the same bit (bit 1) of the 2-bit control word that closes switches S2 also closes switches S1. As such, closing switches S1 while the dipole segments on either end of switches S2 are electrically coupled, couples the dipole segments on either end of switches S2 with respective arms of cross dipoles. The length of the respective arms thus effectively increases by the collective lengths of the respective dipole segments on either end of switches S2. Electromagnetic signals incident on the array element then reflect off the array element with a phase shift of 180 degrees. This condition is illustrated in FIG. 6C.

To achieve a phase shift of 270 degrees, all of the switches of the array element (S1, S2 and S3) are closed. By closing all of the switches, all of the dipole segments become electrically coupled to respective arms of cross dipoles. Thus, the effective length of the arms of the cross dipoles increases by all of the respective dipole segments coupled to the respective arms by switches. This condition is illustrated in FIG. 6D. The following table summarizes these states with reference to the control circuit of FIG. 5.

| Bit 1 | Bit 2 | T1 | T2 | T3 | Δφ |
|---|---|---|---|---|---|
| 0 | 0 | Open | Open | Open | 0° |
| 0 | 1 | Closed | Open | Open | 90° |
| 1 | 0 | Closed | Closed | Open | 180° |
| 1 | 1 | Closed | Closed | Closed | 270° |

To more fully illustrate controlling an array element 22, reference is now drawn to FIG. 7, which illustrates a beam controller 54 capable of operating according to the present invention to control the antenna 12. The beam controller can comprise any of a number of different devices, such as a high level processor or other known electrical hardware capable of performing the functions according to the present invention. In this regard, the beam controller can include a phase shift processor 56 and a shift register 58, where the phase shift processor and shift register can each comprise a processor, hardware and/or software operating within the beam controller. To achieve a desired phase shift of each array element, then, the beam controller typically receives the desired phase shift of the antenna, such as from a digital processor.

With the desired phase shift of the antenna 12, the phase shift processor 56 can determine the 2-bit control word for each array element 22 that, collectively, represents the desired phase shift of the antenna. The control word for each array element can then be transferred to the shift register 58, which receives the control words serially. After the shift register receives the control words, the shift register can output the control words in parallel to the array elements, such as in accordance with operation of the control circuit 38 illustrated in FIG. 5. As groups of array elements may be driven by the same control word to achieve the desired phase shift of the antenna, groups of the array elements can be interconnected in a meandering pattern such that each array element in a respective group receives the same control word.

It should be appreciated that, in addition to imparting different phase shifts to electromagnetic signals incident thereon, the antenna 10 can be configured in a number of other arrangements to thereby manipulate incident electromagnetic signals. For example, the antenna can include a second array of array elements positioned above a first array of array elements, where the second array is positioned orthogonal to the first array. In such an arrangement, a linear polarized electromagnetic wave incident upon the antenna will reflect as an orthogonally polarized electromagnetic wave. In a polarization twist Cassegrain antenna architecture, then, such an arrangement would eliminate the need for a separate circular polarizer.

In addition to being configured as a space fed reflection type electrically scanned antenna, the antenna can be configured as a space fed transmission type electrically scanned antenna. In this regard, according to one embodiment, the antenna can be configured without a ground plane and include a second array of array elements positioned above a first array of array elements, where the arrays are separated by a quarter wavelength. In addition, a feed horn can be situated behind the first array of array elements, opposite the second array. In such an arrangement, the feed horn can provide an incident electromagnetic wave that passes through the arrays. The arrays can then impart a phase shift on the incident electromagnetic wave, which can thereafter be passed through a collimated lens that points the wave in a particular direction. If only one array was present, a forward and backward traveling beam would be created. But by placing the second array a quarter wavelength above the first array, the second array cancels the backward traveling wave by destructive interference (equal magnitude signals that are 180° out of phase).

According to a second configuration of the antenna as a space fed transmission type electrically scanned antenna, the antenna is configured without a ground layer and including two arrays of array elements spaced a quarter wavelength apart, as in the first configuration. In the second configuration, however, the resonant cross dipoles and dipole segments comprise non-resonant elements that can be switched from an inductive susceptance to a capacitive susceptance. The chance of impedance, then, can advance or delay the incident electromagnetic wave passing through the array elements of the arrays. In turn, the two arrays separated by a quarter wavelength can provide the requisite phase shift range with minimum reflection.

Therefore, in embodiments of the electrically scanned antenna and method of forming the same, by controlling each array element 26, a desired degree of phase shift can be imparted by the respective array element to the electromagnetic signal received thereon. Advantageously, this is accomplished without the need for any electromechanical phase shifters. The array elements and the low voltage control circuitry illustrated in FIG. 5 are preferably formed by encapsulating these elements on a wafer using Silicon-on-plastic technology. For an electronically scanned antenna fabricated according to the present invention, the wafer costs will be less than a Gallium Arsenide (GaAs) wafer used in MEMS/MMIC phase shifters. It is also more amenable to large wafer sizes that can accommodate an entire array in a single wafer. This construction promises to provide less complexity and less loss than MEMS/MMIC technology.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. An electronically scanned antenna system comprising:

a plurality of array elements each comprising a plurality of reflecting components capable of reflecting an electromagnetic wave incident thereon, wherein each reflecting component is interconnected to at least one reflecting segment by at least one switch, wherein when the at least one switch is in a closed state a respective reflecting segment is electrically coupled to the respective reflecting component to thereby alter a reflective geometry of the respective reflecting component; and a control system capable of controlling the at least one switch to thereby control said plurality of array elements to provide a desired degree of phase shift to a signal reflected from the antenna, wherein said control system is capable of controlling the at least one switch of one reflecting component at the same time said control system controls corresponding switches of other reflecting components.

2. A system according to claim 1 further comprising a single layer array including the plurality of array elements formed on a substrate.

3. A system according to claim 1, wherein each switch comprises a transistor.

4. A system according to claim 1, wherein each reflecting component comprises a resonant cross dipole, and wherein each reflecting segment comprises a dipole segment.

5. A system according to claim 4, wherein each resonant cross dipole comprises two crossing dipole arms, wherein at least one of the dipole arms is interconnected to a dipole segment of a first length, and wherein at least one of the dipole arms is interconnected to a dipole segment of a second length that is shorter than the first length.

6. A system according to claim 5, wherein the antenna provides a first degree of phase shifting to a received electromagnetic signal when the dipole segments of the second length are electrically coupled to respective dipole arms.

7. A system according to claim 5, wherein at least one dipole segment of the second length is interconnected to a respective dipole arm by a switch on one end and interconnected to another dipole segment by another switch on an opposing end.

8. A system according to claim 7, wherein the antenna provides a first degree of phase shifting to a received electromagnetic signal when the dipole segments of the second length are electrically coupled to respective dipole arms, and wherein the antenna provides a second degree of phase shifting to a received electromagnetic signal when the dipole segments of the second length are electrically coupled to respective dipole arms and the other dipole segments are electrically coupled to respective dipole segments of the second length.

9. A system according to claim 7, wherein the antenna provides a third degree of phase shifting to a received electromagnetic signal when all of the dipole segments are electrically coupled to respective dipole arms and all of the other dipole segments of the second length are electrically coupled to respective dipole segments of the second length.

10. A system according to claim 5, wherein each dipole arm is interconnected to a dipole segment of the first length on one end and a dipole segment of the second length on an opposing end.

11. An electronically scanned antenna comprising:

a plurality of resonant cross dipoles, wherein each resonant cross dipole includes two crossing dipole arms, and wherein said resonant cross dipoles are capable of reflecting an electromagnetic wave incident thereon;

a plurality of dipole segments comprising at least one dipole segment of a first length and at least one dipole segment of a second length that is shorter than the first length; and a plurality of switches capable of interconnecting each resonant cross dipole to at least one dipole segment, wherein a portion of the switches interconnect at least one of the dipole arms of each reflecting component to a dipole segment of a first length, wherein another portion of the switches interconnect at least one of the dipole arms of each reflecting component to a dipole segment of a second length, and wherein when a switch is in a closed state a respective reflecting segment is electrically coupled to the respective reflecting component to thereby alter a reflective geometry of the respective reflecting component to provide a desired degree of phase shift to a signal reflected from the antenna.

12. An antenna according to claim 11, wherein the antenna comprises a single layer array formed on a substrate, wherein the array includes the plurality of resonant cross dipoles, the plurality of dipole segments and the plurality of switches.

13. An antenna according to claim 11, wherein each switch comprises a transistor.

14. An antenna according to claim 11, wherein the antenna provides a first degree of phase shifting to a received electromagnetic signal when the dipole segments of the second length are electrically coupled to respective dipole arms of the cross dipoles of said array elements.

15. An antenna according to claim 11, wherein at least one dipole segment of the second length is interconnected to a respective dipole arm on one end and interconnected to another dipole segment by a switch on an opposing end.

16. An antenna according to claim 15, wherein the antenna provides a first degree of phase shifting to a received electromagnetic signal when the dipole segments of the second length are electrically coupled to respective dipole arms of the cross dipoles of said array elements, and wherein the antenna provides a second degree of phase shifting to a received electromagnetic signal when the dipole segments of the second length are electrically coupled to respective dipole arms and the other dipole segments are electrically coupled to respective dipole segments of the second length.

17. An antenna according to claim 15, wherein the antenna provides a third degree of phase shifting to a received electromagnetic signal when all of the dipole segments are electrically coupled to respective dipole arms of the cross dipoles and all of the other dipole segments of the second length are electrically coupled to respective dipole segments of the second length.

18. An antenna according to claim 11, wherein each dipole arm is interconnected to a dipole segment of the first length on one end and a dipole segment of the second length on an opposing end.

19. A method of forming an electronically scanned antenna comprising:

providing a plurality of resonant cross dipoles capable of reflecting an electromagnetic wave incident thereon, wherein each resonant cross dipole comprises two crossing dipole arms, and wherein at least one dipole arm of each resonant cross dipole is interconnected to at least one dipole segment by at least one switch; and controlling the at least one switch in at least one of an open state and a closed state to thereby operate the antenna to reflect the electromagnetic wave incident thereon, wherein controlling the at least one switch in the closed state comprises controlling the at least one switch in the closed state to electrically couple at least one dipole segment to at least one respective resonant cross dipole to thereby alter a reflective geometry of the at least one respective resonant cross dipole to thereby reflect electromagnetic waves incident upon the antenna with a predefined amount of phase shift.

20. A method according to claim 19, wherein controlling the at least one switch in the open state comprises controlling all of the switches in the open state to thereby operate the antenna to reflect electromagnetic waves incident thereon without imparting any phase shift thereto.

21. A method according to claim 19, wherein providing a plurality of array elements comprises providing a plurality of resonant cross dipoles each comprising two crossing dipole arms, wherein at least one dipole arm of each resonant cross dipole is interconnected to a dipole segment of a first length, and wherein at least one dipole arm of each resonant cross dipole is interconnected to a dipole segment of a second length that is shorter than the first length.

22. A method according to claim 21, wherein controlling the at least one switch comprises controlling the switches interconnecting dipole segments of the second length and respective dipole arms in the closed state to thereby operate the antenna to reflect electromagnetic waves incident thereon with a first degree of phase shift.

23. A method according to claim 21, wherein at least one dipole segment of the second length is interconnected to a respective dipole arm by a switch on one end and interconnected to another dipole segment by another switch on an opposing end, wherein controlling the at least one switch comprises controlling the switches interconnecting the dipole segments of the second length and respective dipole arms in the closed state to thereby operate the antenna to reflect electromagnetic waves incident thereon with a first degree of phase shift.

24. A method according to claim 23, wherein controlling the at least one switch comprises further controlling the switches interconnecting the other dipole segments and respective dipole segments of the second length in the closed state to thereby operate the antenna to reflect electromagnetic waves incident thereon with a second degree of phase shift.

25. A method according to claim 21, wherein controlling the at least one switch comprises controlling the switches interconnecting all of the dipole segments and respective dipole arms in the closed state to thereby operate the antenna to reflect electromagnetic waves incident thereon with a third degree of phase shift.

* * * * *